US009230754B2

(12) United States Patent
Liang et al.

(10) Patent No.: US 9,230,754 B2
(45) Date of Patent: Jan. 5, 2016

(54) POINTING STICK CURSOR KEY AND ILLUMINATED KEYBOARD THEREWITH

(71) Applicants: DARFON ELECTRONICS (SUZHOU) CO., LTD., Suzhou, Jiangsu Province (CN); DARFON ELECTRONICS CORP., Taoyuan (TW)

(72) Inventors: Shih-Sheng Liang, Taoyuan (TW); Hsin-Cheng Ho, Taoyuan (TW); Yen-Chang Chen, Taoyuan (TW)

(73) Assignees: DARFON ELECTRONICS (SUZHOU) CO., LTD., New District, Suzhou, Jiangsu Province (CN); DARFON ELECTRONICS CORP., Gueishan, Taoyuan (TW)

( * ) Notice: Subject to any disclaimer, the term of this patent is extended or adjusted under 35 U.S.C. 154(b) by 56 days.

(21) Appl. No.: 14/328,714

(22) Filed: Jul. 11, 2014

(65) Prior Publication Data

US 2015/0014136 A1 Jan. 15, 2015

(30) Foreign Application Priority Data

Jul. 12, 2013 (TW) ..... 102213235 U

(51) Int. Cl.
*H01H 25/00* (2006.01)
*H01H 13/83* (2006.01)

(52) U.S. Cl.
CPC ..... *H01H 13/83* (2013.01); *H01H 2219/044* (2013.01); *H01H 2219/06* (2013.01); *H01H 2219/062* (2013.01); *H01H 2219/064* (2013.01)

(58) Field of Classification Search
CPC ..... H01H 25/00; H01H 13/70; H01H 13/83; H01H 2219/044; H01H 2219/062; H01H 2219/064; H01H 2219/06; F21V 2008/00; F21V 99/00
See application file for complete search history.

(56) References Cited

U.S. PATENT DOCUMENTS 5,600,313 A * 2/1997 Freedman ..... G06F 3/0219 341/22
5,701,142 A * 12/1997 Brown ..... G05G 9/047 345/161
5,786,806 A * 7/1998 Fester ..... G05G 5/08 345/160
6,040,823 A 3/2000 Seffernick
(Continued)

FOREIGN PATENT DOCUMENTS

CN 201927523 U 8/2011
CN 202871649 U 4/2013
(Continued)

*Primary Examiner* — Bao Q Truong
(74) *Attorney, Agent, or Firm* — Winston Hsu; Scott Margo

(57) ABSTRACT

The illuminated keyboard includes a base plate, a backlight module, a plurality of input keys and a mask layer. The backlight module and the plurality of input keys are disposed on opposite sides of the base plate. The mask layer is disposed between the base plate and the backlight module. A pointing stick cursor key includes a holding structure, an opening and a masking portion. The holding structure with a hole is disposed on the base plate. The opening is formed on the mask layer in a position corresponding to the holding structure. The holding structure is extended into the backlight module via the opening. The at least one masking portion is connected to a periphery of the opening for bendably attaching against the holding structure for covering the hole when the holding structure is extended into the backlight module via the opening.

17 Claims, 4 Drawing Sheets

(56) References Cited

U.S. PATENT DOCUMENTS

| | | | | |
|---|---|---|---|---|
| 6,512,510 | B1 * | 1/2003 | Maeda | G06F 3/0338 345/160 |
| 7,552,142 | B2 * | 6/2009 | Lee | G06F 1/1626 |
| 2013/0135211 | A1 * | 5/2013 | Chiang | G06F 3/02 345/168 |
| 2014/0118989 | A1 | 5/2014 | Chen | |

FOREIGN PATENT DOCUMENTS

| | | | |
|---|---|---|---|
| TW | 392118 | B | 6/2000 |
| TW | M448728 | U1 | 3/2013 |

* cited by examiner

POINTING STICK CURSOR KEY AND ILLUMINATED KEYBOARD THEREWITH

BACKGROUND OF THE INVENTION

1. Field of the Invention

The present invention relates to a pointing stick cursor key and an illuminated keyboard therewith, and more particularly, to a pointing stick cursor key capable of reducing light leakage nearby and an illuminated keyboard therewith.

2. Description of the Prior Art

A keyboard, which is the most common input device, can be found in variety of electronic equipment for users to input characters, symbols, numerals and so on. Recently, as user's visual requirements increase, an illuminated keyboard has become a trend in the industry. Furthermore, in order to enhance interest of operation, a pointing stick cursor key for controlling a mouse cursor arises. A pointing stick cursor key with a force sensing module and a stick member coupled to the force sensing module is disclosed in U.S. Pat. No. 5,568,987. In U.S. Pat. No. 5,568,987, the stick is capable of activating the force sensing module for generating a cursor control signal, so as to control the mouse cursor on the screen.

However, when the pointing stick cursor key is implemented in the aforesaid illuminated keyboard, a base plate of the illuminated keyboard is stamped to forma holding structure for holding the force sensing module. Since the force sensing module occupies a specific volume which increases overall thickness of the illuminated keyboard. Thus, the holding structure for holding the force sensing module is extended into a backlight module for solving the aforesaid issue of overall thickness. In practical application, the aforesaid holding structure is a recessed structure, and it often results in holes on the lateral walls thereof due to thickness of the base plate as being stamped. As a result, a light generated from the backlight module of the illuminated keyboard can project out of the illuminated keyboard via the holes, leading to light leakage in a position corresponding to the holding structure of the illuminated keyboard. Therefore, the leakage light causes issues in appearance of the illuminated keyboard.

SUMMARY OF THE INVENTION

The present invention provides a pointing stick cursor key capable of reducing light leakage nearby and an illuminated keyboard therewith for solving above drawbacks.

According to an embodiment of the present invention, a pointing stick cursor key adapted to an illuminated keyboard is disclosed. The illuminated keyboard includes a base plate, a backlight module, a plurality of input keys and a mask layer. The backlight module is disposed on a side of the base plate. The plurality of input keys is disposed on another side of the base plate. The mask layer is disposed between the base plate and the backlight module. The pointing stick cursor key includes a holding structure, an opening and at least one masking portion. At least one hole is formed on the holding structure, and the holding structure is disposed on the base plate. The opening is formed on the mask layer and located in a position corresponding to the holding structure. The holding structure is extended into the backlight module via the opening. The at least one masking portion is connected to a periphery of the opening and located in a position corresponding to the at least one hole. The at least one masking portion bendably abuts against the holding structure for masking the at least one hole when the holding structure is extended into the backlight module via the opening, so as to prevent a light emitted from the backlight module from projecting out from the other side of the base plate via the at least one hole.

According to another embodiment of the present invention, an illuminated keyboard includes a base plate, a backlight module, a plurality of input keys, a mask layer and a pointing stick cursor key. The backlight module is disposed on a side of the base plate. The plurality of input keys is disposed on another side of the base plate. The mask layer is disposed between the base plate and the backlight module. The pointing stick cursor key includes a holding structure, an opening and at least one masking portion. At least one hole is formed on the holding structure, and the holding structure is disposed on the base plate. The opening is formed on the mask layer and located in a position corresponding to the holding structure. The holding structure is extended into the backlight module via the opening. The at least one masking portion is connected to a periphery of the opening and located in a position corresponding to the at least one hole. The at least one masking portion bendably abuts against the holding structure for masking the at least one hole when the holding structure is extended into the backlight module via the opening, so as to prevent a light emitted from the backlight module from projecting out from the other side of the base plate via the at least one hole.

In summary, the present invention utilizes the masking portion bendably abutting against the holding structure, so as to mask the hole on the lateral portion of the holding structure. In such a manner, the masking portion is capable of preventing the light emitted from the backlight module from projecting out from the other side of the base plate via the hole on the holding structure, so as to reduce light leakage in the position corresponding to the holding structure of the illuminated keyboard and further to enhance visual feeling of the illuminated keyboard in use.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the embodiments, reference is made to the accompanying drawings which form a part hereof, and in which is shown by way of illustration specific embodiments in which the invention may be practiced. In this regard, directional terminology, such as "top," "bottom," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," and "installed" and variations thereof herein are used broadly and encompass direct and indirect connections and installations. Accordingly, the drawings and descriptions will be regarded as illustrative in nature and not as restrictive.

Figure 1:
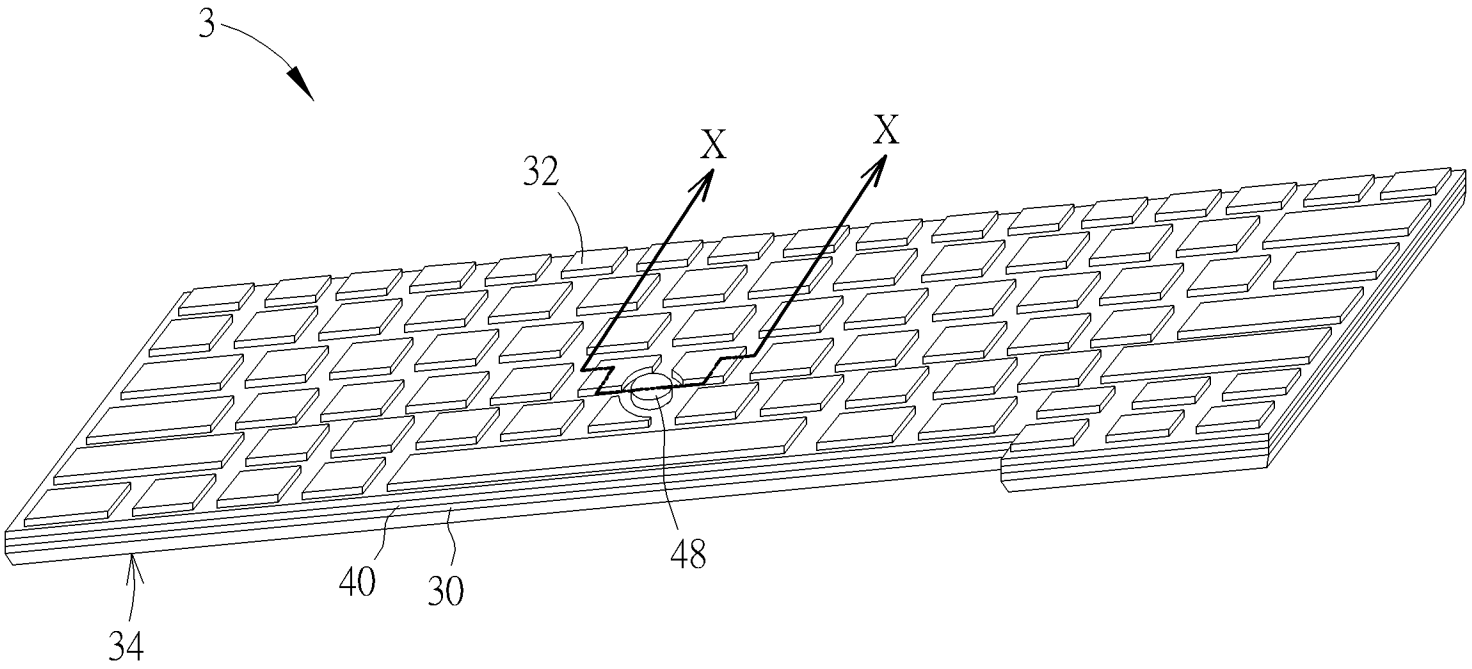
FIG. 1 is a schematic diagram of an illuminated keyboard according to an embodiment of the present invention.
Figure 2:
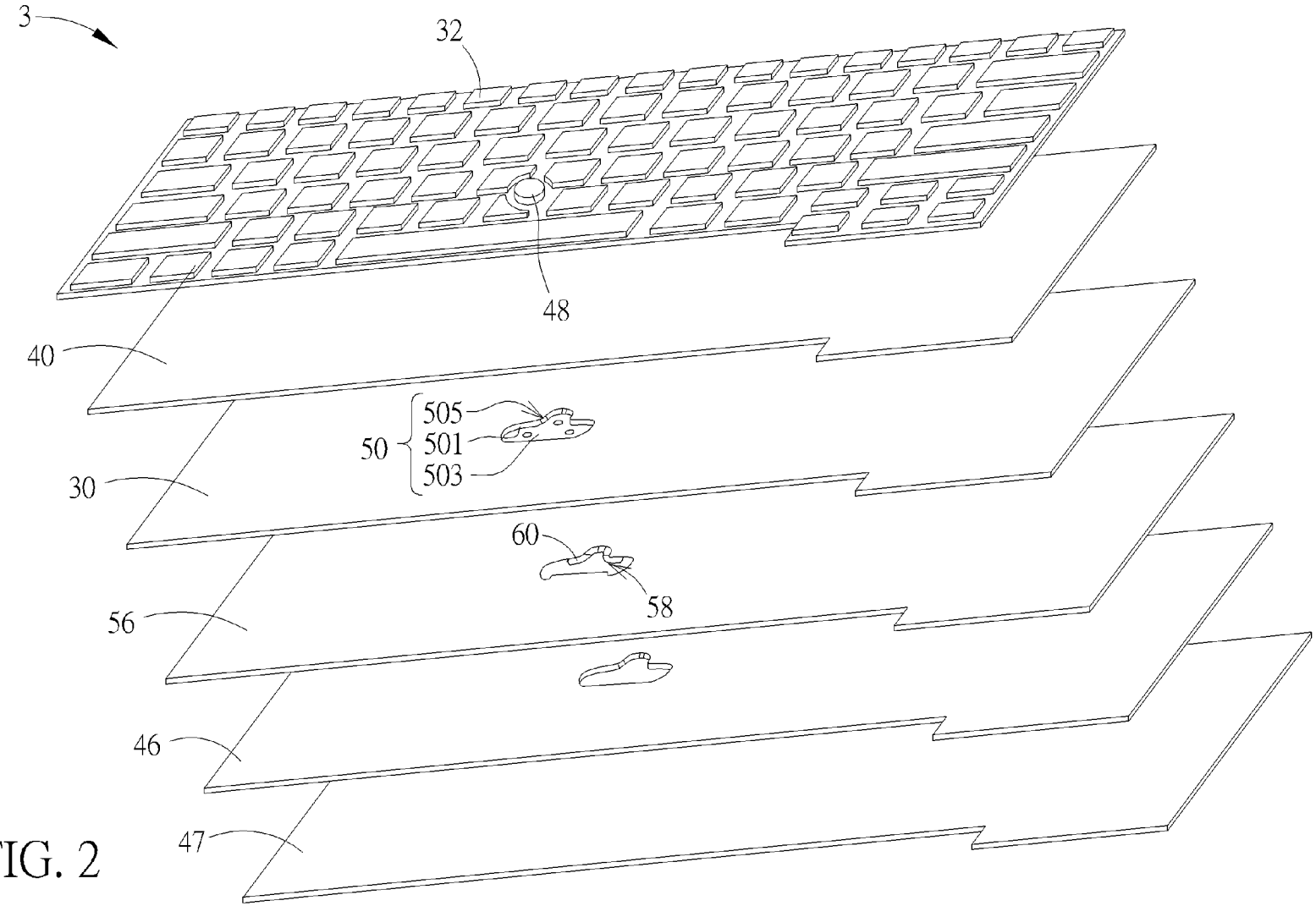
FIG. 2 is an exploded diagram of the illuminated keyboard according to the embodiment of the present invention.

Please refer to FIG. 1 and FIG. 2. FIG. 1 is a schematic diagram of an illuminated keyboard 3 according to an embodiment of the present invention. FIG. 2 is an exploded diagram of the illuminated keyboard 3 according to the embodiment of the present invention. As shown in FIG. 1 and FIG. 2, the illuminated keyboard 3 includes a base plate 30, a plurality of input keys 32 and a backlight module 34. The backlight module 34 is disposed on a side of the base plate 30, e.g. a bottom side of the base plate 30, and for supplying with a light source, such that the illuminated keyboard 3 illuminates for enhancing visual effect of the illuminated keyboard 3 in use. The plurality of input keys 32 is disposed on another side of the base plate 30, e.g. a top side of the base plate 30, for a user to press, so as to perform a desired operation, such as inputting characters, symbols, numerals and so on.

Figure 3:
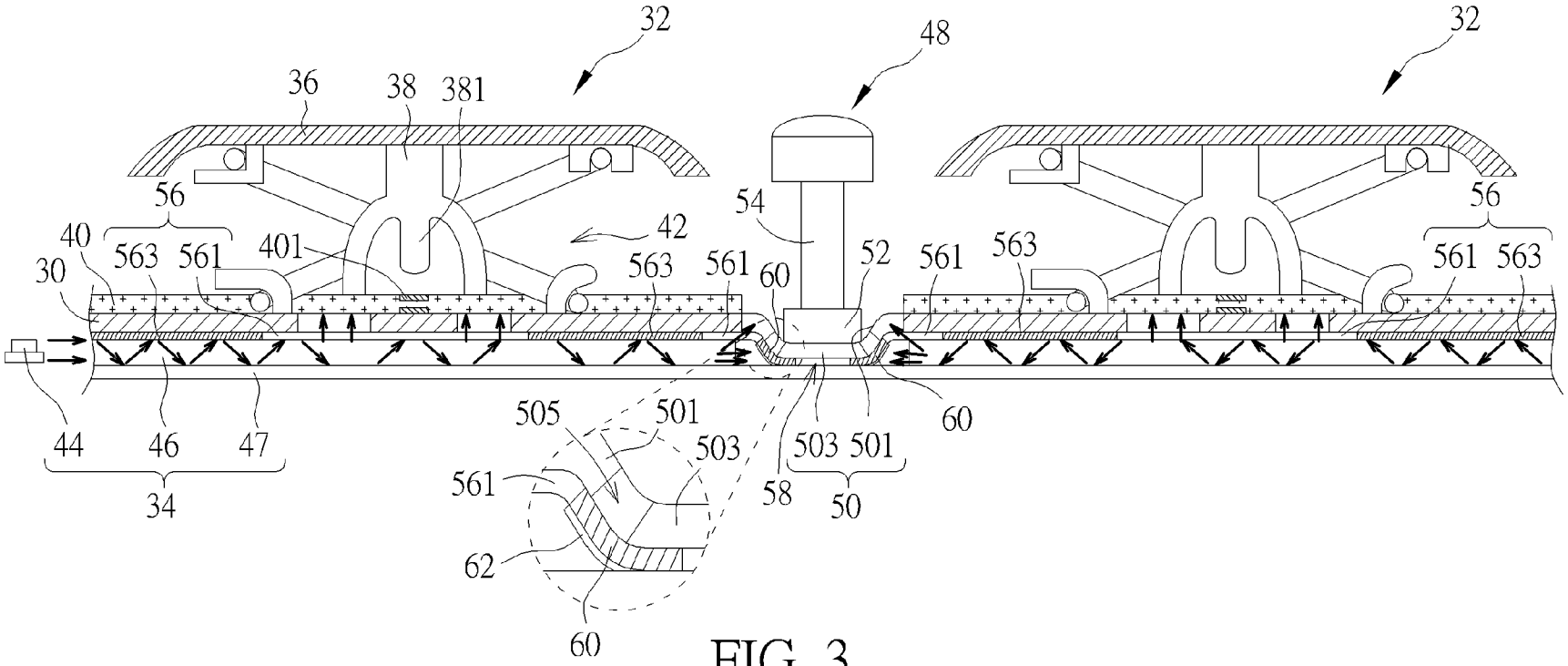
FIG. 3 is a partly sectional diagram of the illuminated keyboard in FIG. 1 along a section line X-X.

Please refer to FIG. 1 to FIG. 3. FIG. 3 is a partly sectional diagram of the illuminated keyboard 3 in FIG. 1 along a section line X-X. As shown in FIG. 1 to FIG. 3, each of the input keys 32 of the illuminated keyboard 3 includes a key cap 36 and a resilient member 38. The key cap 36 is disposed above the other side of the base plate 30, and the resilient member 38 is disposed between the base plate 30 and the key cap 36. When the input key 32 is pressed, the key cap 36 moves toward the base plate 30 and compresses the resilient member 38. Meanwhile, the resilient member 38 stores a potential energy due to elastically deformation. When the pressing movement of the key cap 36 is completed and a finger departs from the key cap 36, the resilient member 38 releases the potential energy and apples the key cap 36 with a resilient force, so as to recover the key cap 36. In this embodiment, the resilient member 38 is a rubber dome, but the present invention is not limited thereto. For example, the resilient member 38 can be a metal spring as well. As for which of the above-mentioned designs is adopted, it depends on practical demands.

Furthermore, the illuminated keyboard 3 further includes a circuit board 40 disposed on the other side of the base plate 30. As shown in FIG. 3, the circuit board 40 has a switch 401 corresponding to each of the input keys 32, and the resilient member 38 has an activating portion 381 corresponding to the switch 401. When the input key 32 is pressed, the resilient member 38 is compressed for the activating portion 381 thereof to press the switch 401 of the circuit board 40, so as to perform a corresponding key instruction. In this embodiment, the circuit board 40 is a membrane, but the present invention is not limited thereto. For example, the circuit board 40 can be a circuit board with key switches as well. As for which one of the above-mentioned designs is adopted, it depends on practical demands.

In addition, each of the input keys 32 further includes a lift mechanism 42 disposed between the base plate 30 and the key cap 36, and the key cap 36 is installed on the lift mechanism 42. When the input key 32 is pressed, the lift mechanism 42 distributes the pressing force on the key cap 36 for making the key cap 36 move downwards relative to the base plate 30, so as to stably perform the key instruction. When the key cap 36 is in the aforesaid recovery process, the lift mechanism 42 distributes the resilient force generated by the resilient member 38 on the key cap 36 for making the key cap 36 move upwards relative to the base plate 30. In summary, the lift mechanism 42 is used for lifting and descending the key cap 36 relative to the base plate 30. In this embodiment, the lift mechanism 42 is a scissors mechanism, but the present invention is not limited thereto. For example, the lift mechanism 42 can be a linkage bar mechanism as well. As for which one of the above-mentioned designs is adopted, it depends on practical demands.

As shown in FIG. 1 to FIG. 3, the backlight module 34 of the illuminated keyboard 3 includes a light emitting unit 44 and a light guide plate 46. The light emitting unit 44 is disposed on a side of the light guide plate 46, and the light guide plate 46 is disposed below the bottom side of the base plate 30. The light emitting unit 44 is used for emitting a light into the light guide plate 46, and the light guide plate 46 is used for guiding the light emitted from the light emitting unit 44 to the key cap 36. In such a manner, the light emitting unit 44 is capable of providing the backlight module 34 with a light source for making the input keys 32 generate visual effect of illumination, so as to enhance visual feeling of the illuminated keyboard 3 in use. In practical application, the backlight module 34 can include one or more than one light emitting units 44 depending on practical demands. In other words, structure including at least one light emitting unit 44 is within the scope of the present invention. As shown in FIG. 3, the light emitting unit 44 of the present invention is disposed on the side of the plurality of input keys 32, i.e. the backlight module 34 of the present invention is an edge-typed backlight module. Furthermore, the backlight module 34 further includes a reflecting plate 47 disposed on a bottom side of the light guide plate 46. When the light guide plate 46 guides the light emitted from the light emitting unit 44, part of the light exits from the bottom side of the light guide plate 46, and the reflecting plate 47 is used for reflecting the light exiting from the bottom side of the light guide plate 46, so as to concentrate the light to project toward the key cap 36.

In addition, the illuminated keyboard 3 further includes a pointing stick cursor key 48, as shown in FIG. 1 to FIG. 3, for controlling a mouse cursor, so as to enhance interest of operating the illuminated keyboard 3. As shown in FIG. 3, the pointing stick cursor key 48 includes a holding structure 50, a force sensing module 52 and a stick member 54. The holding structure 50 is disposed on the base plate 30. The force sensing module 52 is disposed on the holding structure 50. The stick member 54 is coupled to the force sensing module 52 and located among the plurality of input keys 32. During operation, the user can move top portion of the stick member 54, such that the stick member 54 is capable of activating the force sensing module 52 to generate a cursor-control signal, so as to control the mouse cursor on the screen. In such a manner, the user can control the mouse cursor on the screen by the pointing stick cursor key 48 for enhancing the interest of operating the illuminated keyboard 3, e.g. playing games and so on.

Furthermore, the holding structure 50 includes a lateral portion 501 and a bottom portion 503. The lateral portion 501 is connected to the base plate 30, and at least one hole 505 is formed on the lateral portion 501. The bottom portion 503 is connected to the lateral portion 501 and for holding the force sensing module 52, such that the pointing stick cursor key 48 is held on the base plate 30. In practical application, the holding structure 50 can be a recessed structure, which is formed in a stamping manner, on the base plate 30 of the illuminated keyboard 3. The recessed structure can be extended into the backlight module 34 for reducing overall thickness of the illuminated keyboard 3. The bottom portion 503 is a bottom portion of the recessed structure, and the lateral portion 501 is a lateral wall of the recessed structure. In addition, the recessed structure has holes (i.e. the hole 505) formed on a lateral wall (i.e. the lateral portion 501) thereof in the stamping process due to thickness limitation of the base plate 30. An amount and disposal positions of the hole 505 are not limited to those illustrated in figures in this embodiment, and it depends on practical situations.

Figure 4:
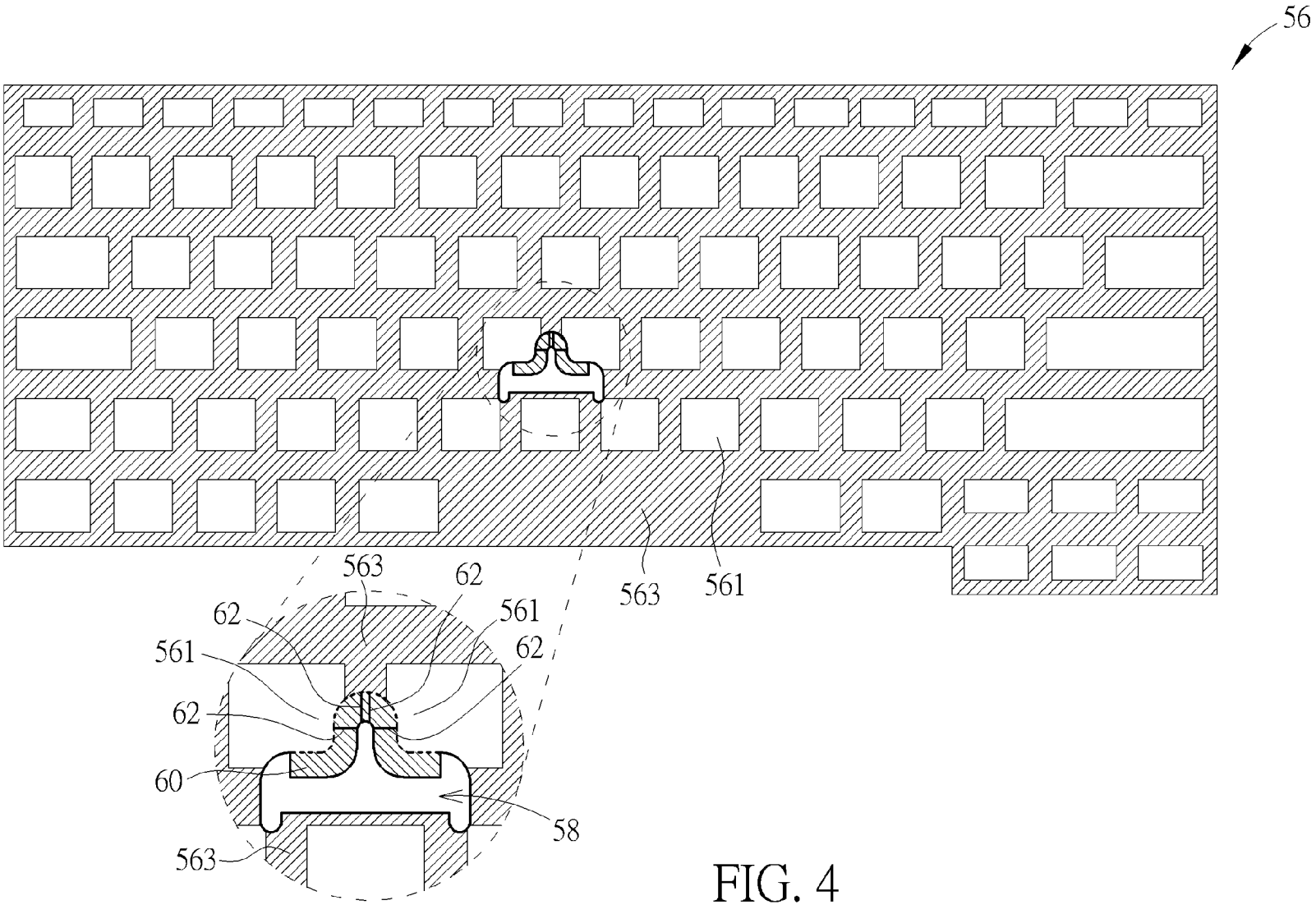
FIG. 4 is a diagram of a mask layer according to the embodiment of the present invention.

As shown in FIG. 2 and FIG. 3, the illuminated keyboard 3 further includes a mask layer 56 dispose between the base plate 30 and the backlight module 34. Please refer to FIG. 2 to FIG. 4. FIG. 4 is a diagram of the mask layer 56 according to the embodiment of the present invention. As shown in FIG. 2 to FIG. 4, the mask layer 56 includes a plurality of transparent portions 561 and an opaque portion 563. The plurality of transparent portions 561 corresponds to the plurality of input keys 32, and the opaque portion 563 connects the plurality of transparent portions 561. The light emitted from the backlight module 34 projects to the plurality of backlight module 34 via the plurality of transparent portions 561. Accordingly, the light is capable of emitting from positions corresponding to the input keys 32 of the illuminated keyboard 3. The opaque portion 563 is used for stopping the light emitted from the backlight module 34, so as to prevent the illuminated keyboard 3 from light leakage and to focus lights to emit in positions corresponding to the input keys 32.

Furthermore, the pointing stick cursor key 48 further includes an opening 58 formed on the mask layer 56 and located in a position corresponding to the holding structure 50. When the backlight module 34 is installed onto the base plate 30, the holding structure 50 formed on the side of the base plate 30 can pass through the mask layer 56 via the opening 58, such that the holding structure 50 is extended into the light guide plate 46. It should be noticed that the opening 58 can further provide a passageway when the holding structure 50 is extended into the backlight module 34 via the opening 58, such that an assembly component (e.g. a screw) passes through the passageway for screwing the holding structure 50 onto a casing of the illuminated keyboard 3.

In addition, the pointing stick cursor key 48 further includes at least one masking portion 60 formed on the mask layer 56 and connected to a periphery of the opening 58. The at least one masking portion 60 corresponds to the hole 505 on the lateral portion 501. Accordingly, when the holding structure 50 is extended into the light guide plate 46 via the opening 58, the masking portion 60 is bent along the lateral portion 501 of the holding structure 50, so as to mask the hole 505 on the lateral portion 501 of the holding structure 50. In such a manner, the masking portion 60 is capable of preventing the light emitted from the backlight module 34 from projecting out from the other side of the base plate 30 via the hole 505 pm the holding structure 50, so as to reduce the light leakage in the position corresponding to the hole 505 on the holding structure 50 of the illuminated keyboard 3 and to enhance visual feeling of the illuminated keyboard 3 in use.

As shown in FIG. 3 and FIG. 4, the masking portion 60 of the pointing stick cursor key 48 is connected to one of the plurality of transparent portions 561 of the mask layer 56. When the holding structure 50 is extended into the backlight module 34 via the opening 58, the masking portion 60 is capable of masking the hole 505 on the lateral portion 501 of the holding structure 50, and the transparent portions 561 connected to the mask layer 56 is bent along the masking portion 60 as well, such that the transparent portions 561 is bendably disposed between the light guide plate 46 of the backlight module 34 and the holding structure 50 on the base plate 30. In such a manner, an arc structure formed by bending the transparent portions 561 is capable of projecting the light emitted from the backlight module 34 to the plurality of input keys 32, so as to enhance uniformity of light emitted from the backlight module 34 for the plurality of input keys 32. In this embodiment, the transparent portions 561 is made of transparent plastic material, and the transparent portions 561 and the opaque portion 563 of the mask layer 56 as well as the masking portion 60 of the pointing stick cursor key 48 are integrally formed.

In this embodiment, the mask layer 56 is a mylar, and the masking portion 60 is made of plastic material with dark color. The present invention is not limited thereto. For example, the masking portion 60 can be coated with a masking layer 62, as shown in FIG. 3. When the masking portion 60 bendably abuts against the holding structure 50 for masking the hole 505 on the lateral portion 501 of the holding structure 50, the masking layer 62 is used for absorbing the light via the hole 505, so as to further reduce the light leakage in the position corresponding to the hole 505 on the holding structure 50 of the illuminated keyboard 3. In this embodiment, the masking layer 62 is made of ink material. In practical application, in order to make the masking layer 62 absorb the light via the hole 505, the masking layer 62 is preferably made of ink material with dark color, e.g. black, instead of ink material with light color, e.g. white. In practical application, the mylar (i.e. the mask layer 56) can abut against the side of the base plate 30 in a glued manner. It should be noticed that there is no glue on the masking portion 60. Accordingly, the holding structure 50 does not be abutted by the masking portion 60 as passing through the opening 58, so as to facilitate assembly and movement of the key.

In addition, the pointing stick cursor key 48 further includes at least one bending structure 64 formed on the masking portion 60 and communicating with the opening 58. In practical application, stiffness of the masking portion 60 itself makes the masking portion 60 hard to be bent, resulting in difficulty of assembly when the masking portion 60 bendably abuts against the holding structure 50. The bending structure 64 is used for reducing the structure of the masking portion 60 for making the masking portion 60 easily to be bent, so as to facilitate abutting process. An amount of the bending structure 64 is not limited to those illustrated in figures in this embodiment, and it depends on practical demands. In other words, structure including at least one bending structure 64 is within the scope of the present invention.

Compared to the prior art, the present invention utilizes the masking portion bendably abutting against the holding structure, so as to mask the hole on the lateral portion of the holding structure. In such a manner, the masking portion is capable of preventing the light emitted from the backlight module from projecting out from the other side of the base plate via the hole on the holding structure, so as to reduce light leakage in the position corresponding to the holding structure of the illuminated keyboard and further to enhance visual feeling of the illuminated keyboard in use.

In addition, the transparent portion of the masking portion is capable of being bent with the masking portion, such that the transparent portion is bendably disposed between the guide light plate of the backlight module and the holding structure of the base plate. In such a manner, the arc structure formed by bending the transparent portions is capable of projecting the light emitted from the backlight module to the plurality of input keys, so as to enhance uniformity of light emitted from the backlight module for the plurality of input keys.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A pointing stick cursor key adapted to an illuminated keyboard, the illuminated keyboard comprising a base plate, a backlight module, a plurality of input keys and a mask layer, the backlight module being disposed on a side of the base plate, the plurality of input keys being disposed on another side of the base plate, the mask layer being disposed between the base plate and the backlight module, the pointing stick cursor key comprising:

a holding structure formed on the base plate, and the holding structure comprising a hole;

an opening formed on the mask layer and located in a position corresponding to the holding structure, the holding structure being extended into the backlight module via the opening; and a masking portion connected to a periphery of the opening and located in a position corresponding to the hole, the masking portion bendably abutting against the holding structure for masking the hole when the holding structure is extended into the backlight module via the opening, so as to prevent a light emitted from the backlight module from projecting out from the other side of the base plate via the hole.

2. The pointing stick cursor key of claim 1, further comprising:

a bending structure formed on the masking portion and communicating with the opening, the bending structure being for bending the masking portion.

3. The pointing stick cursor key of claim 1, wherein the masking portion is coated with a masking layer for absorbing the light via the hole.

4. The pointing stick cursor key of claim 3, wherein the masking layer is made of ink material.

5. The pointing stick cursor key of claim 1, further comprising:

a force sensing module disposed on the holding structure; and a stick member coupled to the force sensing module and located among the plurality of input keys, the stick member being moved to activate the force sensing module to generate a cursor-control signal.

6. The pointing stick cursor key of claim 5, wherein the holding structure comprises:

a lateral portion connected to the base plate, wherein the hole is formed on the lateral portion and the masking portion is bent along the lateral portion for masking the hole; and a bottom portion connected to the lateral portion and for holding the force sensing module.

7. The pointing stick cursor key of claim 1, wherein the masking portion is made of plastic material with dark color.

8. An illuminated keyboard, comprising:

a base plate;

a backlight module disposed on a side of the base plate;

a plurality of input keys disposed on another side of the base plate;

a mask layer disposed between the base plate and the backlight module; and a pointing stick cursor key, comprising:

a holding structure formed on the base plate, and the holding structure comprising a hole;

an opening formed on the mask layer and located in a position corresponding to the holding structure, the holding structure being extended into the backlight module via the opening; and a masking portion connected to a periphery of the opening and located in a position corresponding to the hole, the masking portion bendably abutting against the holding structure for masking the hole when the holding structure is extended into the backlight module via the opening, so as to prevent a light emitted from the backlight module from projecting out from the other side of the base plate via the hole.

9. The illuminated keyboard of claim 8, wherein the pointing stick cursor key further comprises:

a bending structure formed on the masking portion and communicating with the opening, the bending structure being for bending the masking portion.

10. The illuminated keyboard of claim 8, wherein the masking portion is coated with a masking layer for absorbing the light via the hole.

11. The illuminated keyboard of claim 10, wherein the masking layer is made of ink material.

12. The illuminated keyboard of claim 8, wherein the pointing stick cursor key further comprises:

a force sensing module disposed on the holding structure; and a stick member coupled to the force sensing module and located among the plurality of input keys, the stick member being moved to activate the force sensing module to generate a cursor-control signal.

13. The illuminated keyboard of claim 12, wherein the holding structure comprises:

a lateral portion connected to the base plate, wherein the hole is formed on the lateral portion and the masking portion is bent along the lateral portion for masking the hole; and a bottom portion connected to the lateral portion and for holding the force sensing module.

14. The illuminated keyboard of claim 8, wherein the masking portion is made of plastic material with dark color.

15. The illuminated keyboard of claim 8, wherein the mask layer comprises:

a plurality of transparent portions corresponding to the plurality of input keys, the light emitted from the backlight module projecting to the plurality of input keys via the plurality of transparent portions.

16. The illuminated keyboard of claim 8, wherein each of the input keys comprises:

a key cap disposed above the other side of the base plate; and a lift mechanism disposed between the base plate and the key cap, the lift mechanism being for lifting and descending the key cap relative to the base plate.

17. The illuminated keyboard of claim 8, wherein the backlight module comprises:

a light guide plate disposed on the side of the base plate and for guiding the light to the key cap;

a light emitting unit disposed on a side of the light guide plate and for emitting the light to the light guide plate; and a reflecting plate disposed on a bottom side of the light guide plate and for reflecting the light exiting from the light guide plate.

* * * * *